US010376108B2

(12) United States Patent
Morand

(10) Patent No.: US 10,376,108 B2
(45) Date of Patent: Aug. 13, 2019

(54) ROLLED PRODUCT DISPENSER

(71) Applicant: CASCADES CANADA ULC, Montreal (CA)

(72) Inventor: Michel Morand, Verdun (CA)

(73) Assignee: CASCADES CANADA ULC, Montreal (CA)

( * ) Notice: Subject to any disclaimer, the term of this patent is extended or adjusted under 35 U.S.C. 154(b) by 252 days.

(21) Appl. No.: 15/305,303

(22) PCT Filed: May 11, 2015

(86) PCT No.: PCT/CA2015/050424

§ 371 (c)(1),
(2) Date: Oct. 19, 2016

(87) PCT Pub. No.: WO2015/168807

PCT Pub. Date: Nov. 12, 2015

(65) Prior Publication Data

US 2017/0042391 A1 Feb. 16, 2017

Related U.S. Application Data

(60) Provisional application No. 61/990,910, filed on May 9, 2014.

(51) Int. Cl.

| | |
|---|---|
| ***A47K 10/32*** | (2006.01) |
| ***A47K 10/34*** | (2006.01) |
| ***A47K 10/36*** | (2006.01) |

(52) U.S. Cl.

CPC ..... *A47K 10/34* (2013.01); *A47K 10/32* (2013.01); *A47K 10/3643* (2013.01); *A47K 2010/3675* (2013.01)

(58) Field of Classification Search

CPC ..... A47K 10/34; A47K 10/3643; A47K 2010/3675; A47K 2010/3863;
(Continued)

(56) References Cited

U.S. PATENT DOCUMENTS 2,224,572 A * 12/1940 Harvey ..... A47K 10/38 226/121

2,322,531 A 6/1943 Maltby et al.

(Continued)

OTHER PUBLICATIONS

International Search Report and Written Opinion for Application No. PCT/CA2015/050424, dated Jul. 21, 2015.

*Primary Examiner* — Michael R Mansen
*Assistant Examiner* — Raveen J Dias
(74) *Attorney, Agent, or Firm* — Marshall, Gerstein & Borun LLP

(57) ABSTRACT

A rolled product dispenser for dispensing a web of rolled product is described. The rolled product dispenser comprises a dispensing assembly, a return mechanism, and a blocking mechanism. The dispensing assembly includes a rotating drum assembly having a peripheral wall configured to be contoured at least partially by the web of rolled product. The rotating drum assembly is rotatable in a dispensing rotation direction and a counter dispensing rotation direction along at least 90 degrees. The return mechanism biases the rotating drum towards a stationary configuration by rotating same in the counter dispensing rotation direction. The blocking mechanism is engageable with the rotating drum assembly to prevent rotation thereof in the counter dispensing rotation direction beyond at least one predetermined angular position.

10 Claims, 7 Drawing Sheets

(58) Field of Classification Search
CPC ..... A47K 10/3656; A47K 10/3687; A47K 10/36; A47K 10/38; A47K 10/3612; A47K 10/3618; A47K 2010/3683; B65H 35/0006; B65H 16/00; B65H 16/005; B65H 16/10; B65H 16/103; B65H 16/106; B65H 49/34
USPC ..... 242/564, 564.1, 564.4, 565, 573
See application file for complete search history.

(56) References Cited

U.S. PATENT DOCUMENTS 3,896,691 A * 7/1975 Granger ..... B65H 35/0066 83/335
4,122,738 A * 10/1978 Granger ..... B26D 1/425 83/191
4,131,044 A * 12/1978 Cassia ..... B26D 5/26 83/205
4,307,638 A * 12/1981 DeLuca ..... A47K 10/3687 226/91
4,307,639 A * 12/1981 DeLuca ..... A47K 10/3631 226/91
6,079,305 A * 6/2000 Bloch ..... B65H 19/10 83/335
6,415,948 B1 * 7/2002 Granger ..... A47K 10/3637 221/30
6,446,901 B1 * 9/2002 Haen ..... B65H 35/006 225/12
6,581,500 B1 * 6/2003 Kietaibl ..... A47K 10/3643 225/39
7,841,556 B2 * 11/2010 Elliott ..... A47K 10/3687 242/564.2
8,146,471 B2 4/2012 Hansen et al.
2002/0117578 A1 * 8/2002 Denen ..... B65H 35/10 242/563
2008/0217350 A1 * 9/2008 Hansen ..... A47K 10/3643 221/15

* cited by examiner

ROLLED PRODUCT DISPENSER

CROSS REFERENCE TO RELATED APPLICATION

This application claims the benefit under 35 U.S.C. § 119(e) of U.S. provisional patent application No. 61/990.910 which was filed on May 9, 2014. The entirety of the aforementioned application is herein incorporated by reference. This application is a national phase entry of PCT patent application serial number PCT/CA2015/050424 filed on May 11, 2015, (now pending) designating the United States of America.

FIELD OF THE INVENTION

The present invention relates to the field of dispensers. More particularly, it relates to a dispenser for rolled products such as rolled paper products, which is configured to substantially control a length of a tail of rolled product extending outside of the dispenser.

BACKGROUND

Several types and models of rolled product dispensers are known in the art for dispensing a length of rolled product to a user. For example and without being limitative, such dispensers are commonly found in public bathrooms for dispensing hand paper towels to users.

In many cases, the length of rolled product is dispensed following a pull of the user on a portion of the web of rolled product dangling at a lower front section of the dispenser. This portion of the web of rolled product is commonly referred to as the "tail".

It is common for users to pull sharply on the tail of the web of rolled product and consequently cause a dispensing roller of the dispenser to overspin, i.e. to continue to rotate after the user has stopped pulling on the tail of the web of rolled product, thereby leading to a length of the tail of the web of rolled product that is inappropriate, i.e. that is longer than desired. Such inappropriate length is undesirable as it may, for example and without being limitative, lead to bacterial contamination and/or product waste.

Rolled product dispensers are also commonly equipped with a turn knob for manually rotating the rotating drum assembly, if needed. For instance, manual rotation of the drum can be necessary in the event of an unwanted tear of the paper and when a new roll is introduced to the dispenser. Rotating the drum in the wrong direction can cause the product web to unthread from the dispensing mechanism or even damage the dispensing mechanism. To avoid misuse, the turn knob is often coupled to the drum via a one-way clutch bearing or one-way clutch spring allowing the turn knob to be rotated in only one direction.

In view of the above, there is a need for an improved rolled product dispenser, which by virtue of its design and components, would be able to overcome or at least minimize some of the above-discussed prior art concerns.

SUMMARY OF THE INVENTION

According to a general aspect, there is provided a rolled product dispenser for dispensing a web of rolled product. The rolled product dispenser comprises: a housing; a dispensing assembly at least partially housed in the housing and interacting with the web of rolled product, the dispensing assembly including a rotating drum assembly rotatable in a dispensing rotation direction and a counter dispensing rotation direction; a return mechanism biasing the rotating drum assembly towards a stationary configuration by rotating same in the counter dispensing rotation direction; and a blocking mechanism allowing rotation of the rotating drum assembly in the dispensing rotation direction and preventing rotation of the rotating drum assembly in the counter dispensing rotation direction beyond at least one predetermined angular position.

In an embodiment, the blocking mechanism includes a stopper and the rotating drum assembly comprises at least one tooth protruding radially from a section of the rotating drum assembly, the stopper being engageable with the at least one tooth to prevent rotation of the rotating drum assembly in the counter dispensing rotation beyond the at least one predetermined angular position. The stopper can be pivotally mounted to one of a dispensing assembly frame and the housing through a pivoting assembly. The pivoting assembly can bias an engagement end of the stopper towards a periphery of the rotating drum assembly.

According to a general aspect, there is provided a rolled product dispenser for dispensing a web of rolled product. The rolled product dispenser comprises: a dispensing assembly including a rotating drum assembly having a peripheral wall configured to be contoured at least partially by the web of rolled product and being rotatable in a dispensing rotation direction and a counter dispensing rotation direction along at least 60 degrees; a return mechanism biasing the rotating drum assembly towards a stationary configuration by rotating same in the counter dispensing rotation direction; and a blocking mechanism engageable with the rotating drum assembly to prevent rotation thereof in the counter dispensing rotation direction beyond at least one predetermined angular position.

In an embodiment, the blocking mechanism includes a stopper and the rotating drum assembly comprises at least one tooth protruding radially from the rotating drum assembly, the stopper being engageable with the at least one tooth to prevent rotation of the rotating drum assembly in the counter dispensing rotation beyond the at least one predetermined angular position. The stopper can be pivotally mounted to one of a dispensing assembly frame and a housing of the rolled product dispenser through a pivoting assembly. The at least one tooth can protrude from the peripheral wall of a section of the rotating drum assembly and the pivoting assembly can bias an engagement end of the stopper towards the peripheral wall of the section of the rotating drum assembly.

In an embodiment, the rotating drum assembly comprises at least two spaced-apart sets of at least one tooth engageable with the stopper when the rotating drum assembly is rotated in the counter dispensing rotation direction and toothless circular arc segments extending between each one of the at least two spaced-apart sets at a periphery of the section of the rotating drum assembly. At least one of the toothless circular arc segments can extend along at least 60 degrees or along at least 90 degrees. In an embodiment, each one of the toothless circular arc segments extends along at least 90 degrees.

In an embodiment, the rotating drum assembly comprises at least one set of adjacent teeth engageable with the stopper when the rotating drum assembly is rotated in the counter dispensing rotation direction and at least one toothless circular arc segment extending forwardly of a first one of the teeth encountered by the stopper when the rotating assembly is rotated in the counter dispensing rotation direction. The at least one toothless circular arc segment can extend along at least 60 degrees or along at least 90 degrees.

In an embodiment, the rotating drum assembly comprises one set of adjacent and consecutive teeth engageable with the stopper when the rotating drum assembly is rotated in the counter dispensing rotation direction with a toothless circular arc segment extending between a first one of the teeth and a last one of the teeth of the set at a periphery of the section of the rotating drum assembly. The set of adjacent and consecutive teeth can comprise five or less teeth. The toothless circular arc segment can extend over at least 60 degrees or over at least 90 degrees. In an embodiment, at least 300 degrees of the periphery of the section of the rotating drum assembly includes the at least one toothless circular arc segment.

In an embodiment, the rotating drum assembly comprises two opposed teeth, each one of the two opposed teeth being engageable with the stopper to prevent rotation of the rotating drum assembly in the counter dispensing rotation beyond one of the at least one predetermined angular position defined by each one of the teeth.

BRIEF DESCRIPTION OF THE DRAWINGS

Other objects, advantages and features will become more apparent upon reading the following non-restrictive description of embodiments thereof, given for the purpose of exemplification only, with reference to the accompanying drawings in which.

DETAILED DESCRIPTION

In the following description, the same numerical references refer to similar elements. The embodiments, geometrical configurations, materials mentioned and/or dimensions shown in the figures or described in the present description are embodiments only, given solely for exemplification purposes.

Moreover, although the embodiments of the rolled product dispenser and corresponding parts thereof consist of certain geometrical configurations as explained and illustrated herein, not all of these components and geometries are essential and thus should not be taken in their restrictive sense. It is to be understood, as also apparent to a person skilled in the art, that other suitable components and cooperation thereinbetween, as well as other suitable geometrical configurations, may be used for the rolled product dispenser, as will be briefly explained herein and as can be easily inferred herefrom by a person skilled in the art. Moreover, it will be appreciated that positional descriptions such as "above", "below", "left", "right" and the like should, unless otherwise indicated, be taken in the context of the figures and should not be considered limiting.

Figure 1:
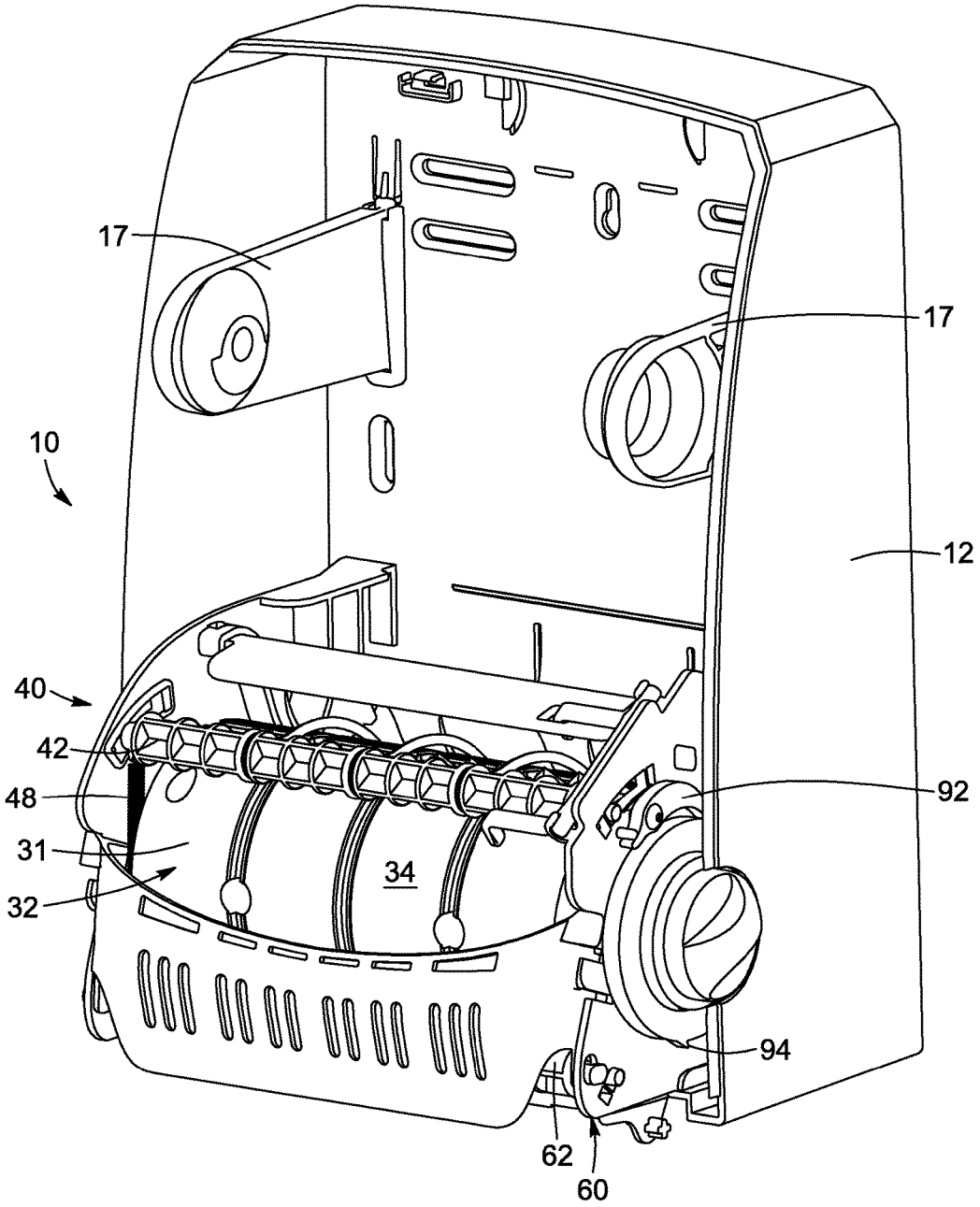
FIG. 1 is a perspective view of a rolled product dispenser, according to an embodiment, with a housing, without a front cover thereof, within which the components of the dispenser are contained.

Referring now to the figures, there is shown an embodiment of a rolled product dispenser 10. FIG. 1 presents the rolled product dispenser 10 within a housing 12, free of front cover, within which the components of the dispenser 10 are contained. FIGS. 2 to 5 present the rolled product dispenser 10 with the housing 12 removed, in order to show the components of the dispenser 10 more clearly for the benefit of the present description.

Figure 2:
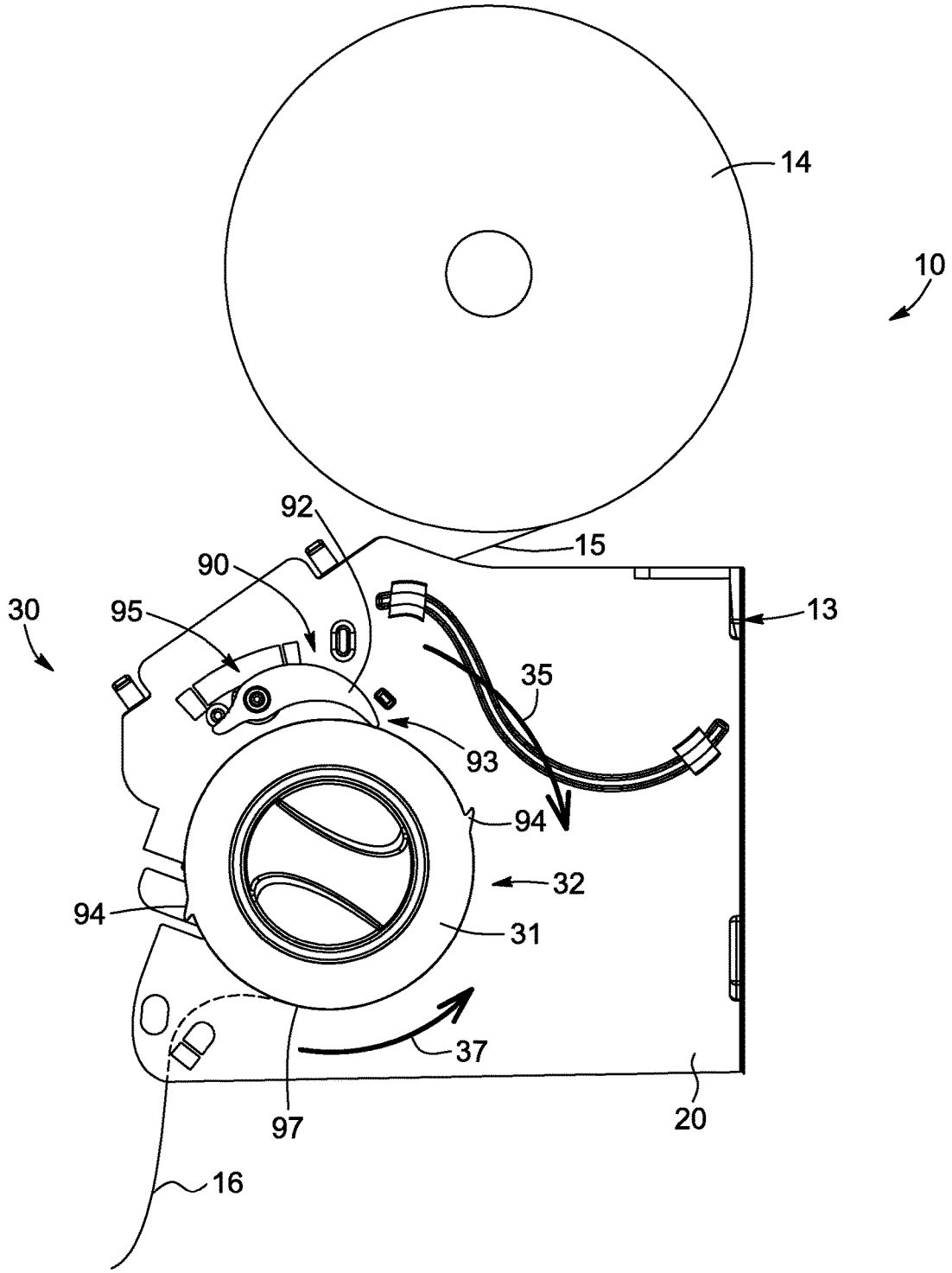
FIG. 2 is a right side elevation view of the rolled product dispenser of FIG. 1, where the housing has been removed and where the blocking mechanism includes opposed teeth extending radially from a periphery of a rotating drum assembly, the dispensing assembly of the rolled product dispenser being shown in an extended configuration.
Figure 3:
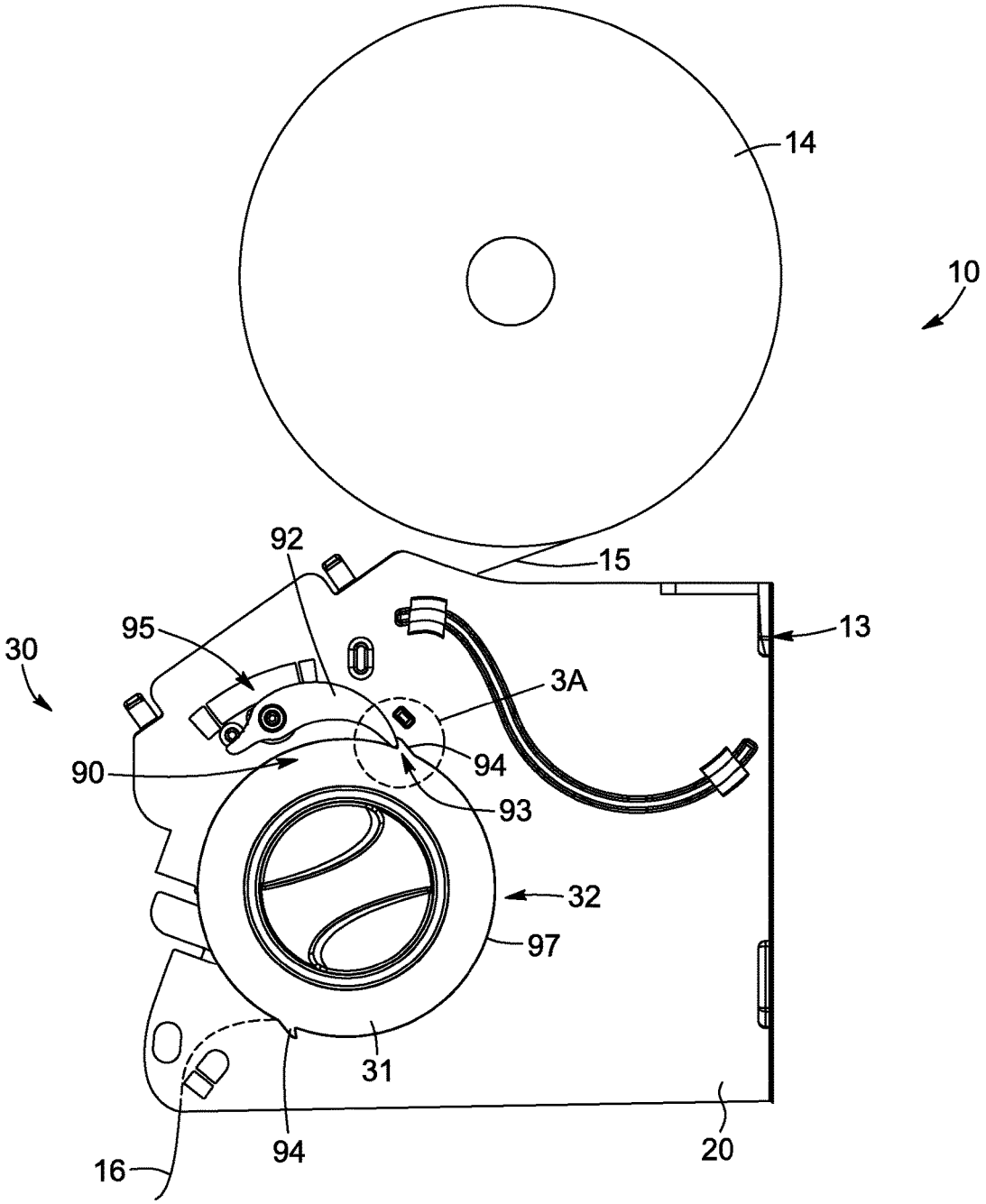
FIG. 3 is a right side elevation view of the rolled product dispenser of FIG. 2, where the dispensing mechanism of the rolled product dispenser is shown in a stationary configuration.

Referring now to FIGS. 1 to 3, there is shown that the rolled product dispenser 10 for a rolled product 14 includes a dispensing assembly frame 13 and a dispensing assembly 30. The dispensing assembly 30 is configured to dispense lengths of a web 15 of rolled product 14.

As will be easily understood by one skilled in the art, the rolled product 14 can be a web 15 of absorbent sheet product provided in rolled configuration, such as and without being limitative, hand paper towel. In an alternative embodiment, the rolled product 14 can also be other types of paper provided in a roll, such as, without being limitative, hygienic paper, or other types of rolled product, such as cling film, foil or the like.

The frame 13 supports the dispensing assembly 30 in the housing 12, if any. In an alternative embodiment, the dispensing assembly 30 can be mounted directly to the housing. In an embodiment, the rolled product 14 is mounted above the dispensing assembly 30 and is supported by a rolled product support 17 (FIG. 1). In the embodiment shown, the rolled product support 17 includes two spaced-apart arms and the rolled product 14 extends between the two arms when engaged therewith. In the embodiment shown, the rolled product support 17 is secured to the housing 12 of the rolled product dispenser 10.

The housing 12 also includes a rolled product dispensing opening (not shown) through which a tail 16 of the rolled product 14 extends outwardly from the housing 12.

In an embodiment, the housing 12 and/or the frame 13 is made of moulded plastic such as acrylonitrile butadiene styrene (ABS). One skilled in the art would however understand that, in alternative embodiments, other materials offering similar characteristics could be used in the manufacture of the frame 13 and/or the housing 12.

In an embodiment, the dispensing assembly 30 includes a rotating drum assembly 32 (or dispensing roller), rotatably mounted to the frame 13. The rotating drum assembly 32 includes a cutting drum 31 extending between spaced-apart supporting members 18 and 20. The rotating drum assembly 32 rotates around a rotation center 33 and can be rotated in a dispensing rotation direction 35 and a counter dispensing rotation direction 37, for only a portion of a complete rotation, as will be described in more details below. In the context of this specification, the term "rotating drum assembly" includes the cutting drum 31 and any handle or extension that rotates simultaneously together around the rotation center 33.

Referring to FIG. 1, the cutting drum 31 has a peripheral wall 34 engaging the web 15 of rolled product 14. In an embodiment, the peripheral wall 34 of the cutting drum 31 can be made of a friction-enhanced material (or anti-skid material) in order to increase the friction between the cutting drum 31 and the web 15 of rolled product 14. When a user pulls on the tail 16 of the web 15 of rolled product 14 extending outwardly of the housing 12 through the rolled product dispensing opening, the cutting drum 31 rotates in the dispensing rotation direction 35 and a length of web 15 of rolled paper product 14 is dispensed to the user.

In an embodiment, the cutting drum 31 includes a cutting assembly (not shown) housed in the cutting drum 31 and configured to cut the web 15 of rolled product 14 after a predetermined length has been dispensed. One skilled in the art would however understand that, in alternative embodiments, other mechanisms or assemblies for automatically or manually cutting the web 15 of rolled product 14 could be provided.

Figure 5:
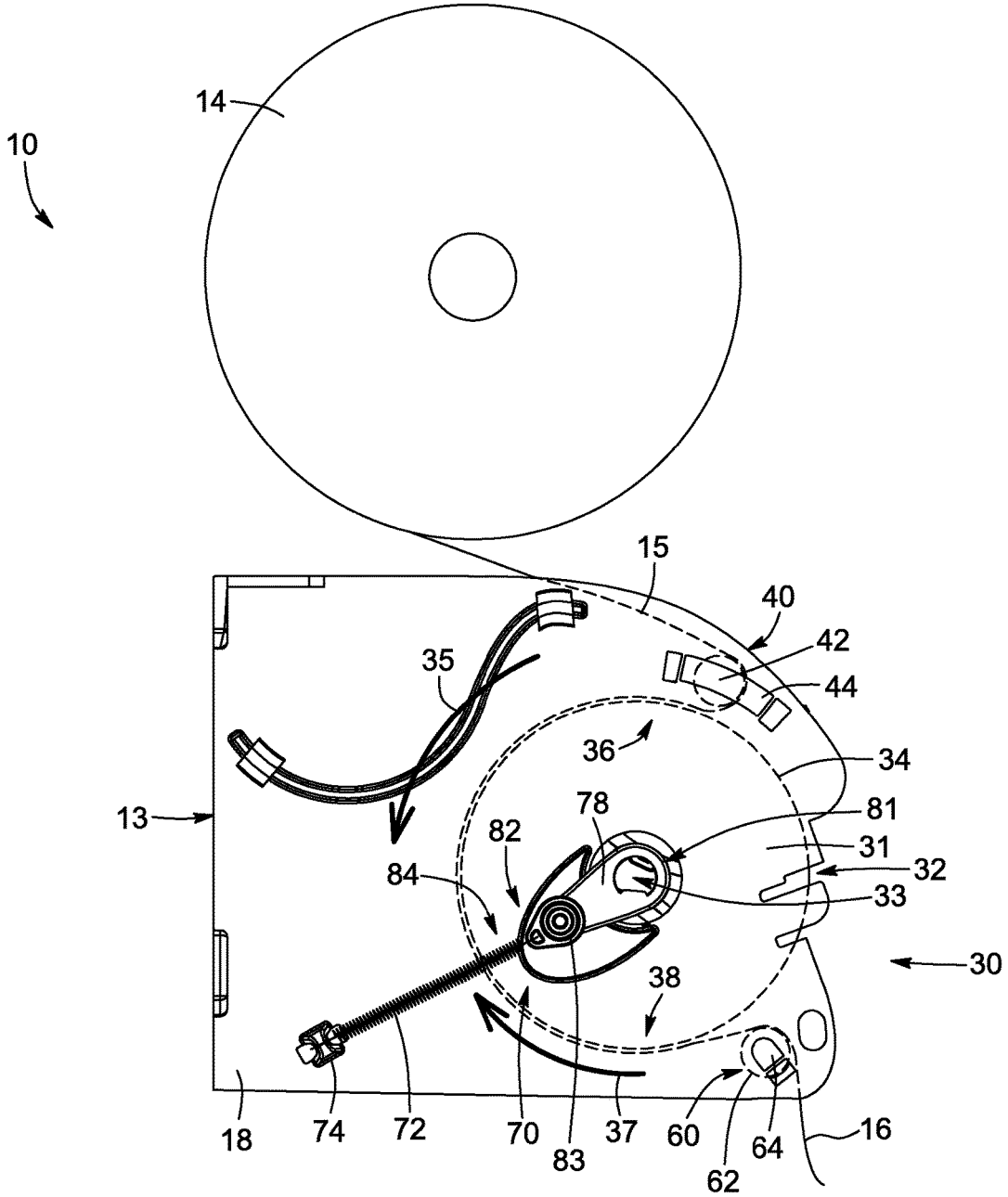
FIG. 5 is a left side elevation view of the rolled product dispenser of FIG. 1, where the housing has been removed and where the dispensing mechanism of the rolled product is shown in the retracted configuration.

Referring to FIGS. 1 and 5, in an embodiment, the dispensing assembly 30 includes an upper tensioning mechanism 40 pulling the web 15 of rolled product 14 forwardly of the housing 12 before the web 15 of rolled product 14 extends rearwardly to contour an upper section 36 of the cutting drum 31. The upper tensioning mechanism 40 includes an upper tensioning roller 42, slidably mounted in elongated upper grooves 44 defined in the supporting members 18 and 20 respectively, pulling the web 15 of rolled product 14 downwards towards the front of the cutting drum 31 and configured to vary the length of web of rolled product 15 which contours the upper section 36 of the cutting drum 31. In the illustrated embodiment, the upper groove 44 is configured such that the upper tensioning mechanism conforms to a section of the peripheral wall 34 of the cutting drum 31, while being spaced apart thereof. The upper tensioning mechanism 40 further includes a biasing member 48, such as a spring or the like, biasing the upper tensioning roller 42 forwardly, i.e. towards a front section of the housing 12.

In an embodiment, the dispensing assembly 30 further includes a lower tensioning mechanism 60 having a lower tensioning roller 62 pulling the web 15 of rolled product 14 upwards towards the front of the cutting drum 31 and against a lower section 38 of the peripheral wall 34 of the cutting drum 31. In the illustrated embodiment, the lower tensioning roller 62 is slidably mounted in lower grooves 64 defined in the supporting members 18 and 20 respectively to vary the tension imparted on the web of rolled product 15 contouring the cutting drum 31. The lower tensioning mechanism 60 further includes a biasing member biasing the lower tensioning roller 62 upwards, towards an upper end of the lower groove 64. In the non-limitative embodiment shown, the same biasing member 48 is connected to both the upper tensioning roller 42 and the lower tensioning roller 62 and is used to bias the upper tensioning roller 42 forwardly and the lower tensioning roller 62 upwardly.

One skilled in the art will understand that, in alternative embodiments, other mechanisms or configuration of the dispensing assembly 30, distinct from the above described upper tensioning mechanism 40 and lower tensioning mechanism 60 can also be provided. In such alternative embodiment, the alternative mechanism and/or configuration of the dispensing assembly 30 can be provided to guide the web 15 of rolled product 14 such that it increases the portion of the peripheral wall 34 of the cutting drum 31 contoured by the web 15 of rolled product 14, i.e. such that the web 15 of rolled product 14 contours the peripheral wall 34 of the cutting drum 31 along a substantial portion thereof.

Referring to FIG. 5, the dispenser 10 is further provided with a return mechanism 70 configured to bias the rotating drum assembly 32, such that it rotates back to its original angular position (neutral position) within the dispenser 10, following a rotation of the rotating drum assembly 32 in the dispensing rotation direction 35 caused by a pull on the tail 16 of the web 15 of rolled product 14 by a user. One skilled in the art will understand that the return mechanism 70 can be provided independently or in combination with either one, or both of the upper tensioning mechanism 40 and the lower tensioning mechanism 60.

In the illustrated embodiment, the return mechanism 70 includes a biasing member 72, such as, without being limitative, a spring or any other resilient element, connected at a first end to an anchor 74 provided on the supporting member 18, and connected at a second end to one of the longitudinal ends of the rotating drum assembly 32 and, more particularly, on an extension mounted outwardly of the supporting member 18. One skilled in the art would understand that the anchor 74 may be integral to the supporting member 18 or be an independent component removable or permanently connected thereto. Moreover, it will be understood that, in an alternative embodiment, the anchor 74 can be provided on a component other than the supporting member 18, such as, for example, the housing 12.

On the rotating drum assembly 32, the biasing member 72 is connected to an eccentric attachment point 84, i.e. a connection point spaced apart from the rotation center 33 of the rotating drum assembly 32. The eccentric attachment point 84 is provided by a connection arm 78 attached to the longitudinal end of the rotating drum assembly 32 and having a first end 81 proximate to the rotation center 33 of the rotating drum assembly 32 and a second end 82 spaced apart from the rotation center 33 of the rotating drum assembly 32. The connection arm 78 is secured to the rotating drum assembly 32 to rotate simultaneously with the rotating drum assembly 32. The second end 82 of the arm 78 provides the eccentric attachment point 84 for the biasing member 72. In the illustrated embodiment, a rotating head 83 is rotatably connected to the connection arm 78, at the second end 82 thereof, to attach the biasing member 72 thereon. One skilled in the art would however understand that, in alternative embodiments, different components or structures can be provided for rotatingly connecting the biasing member 72 to the second end 82 of the connection arm 78.

One skilled in the art will understand that, in alternative embodiments, other configurations providing the ability to manually vary the tension imparted on the biasing member 72 and/or vary the original angular position of the rotating drum assembly 32 could also be provided. For example and without being limitative, in an alternative embodiment (not shown), a plurality of anchors and/or a plurality of attachment points 84 could be provided. In another alternative embodiment (not shown), adjusting pins may be provided between the anchor 74 and the attachment point 84 to modify the path of the biasing member 72 and provide a variable tension on the biasing member 72 according to which one of the adjusting pins is used to vary the path.

As mentioned above, when a user pulls on the tail 16 of the web 15 of rolled product 14 extending outwardly of the housing 12 through the rolled product dispensing opening, the rotating drum assembly 32 rotates in the dispensing rotation direction 35 and a length of web 15 of rolled paper product 14 is dispensed to the user. Following rotation of the rotating drum assembly 32 in the dispensing rotation direction 35, the return mechanism 70 causes the rotation of the rotating drum assembly 32 in the counter dispensing rotation direction 37, towards a stationary configuration. The rotation in the counter dispensing rotation direction 37 contributes to reduce the length of the product tail 16, as the web 15 of rolled product is driven back inside by the rotation of the rotating drum assembly 32 in the counter dispensing rotation direction 37.

Referring to FIGS. 2 to 4*a*, in order to prevent rotation of the rotating drum assembly 32 beyond at least one predetermined angular position in the counter dispensing rotation direction 37, the dispenser 10 is further provided with a blocking mechanism 90. The blocking mechanism 90 is also used to control the length of the product tail 16, following a pull by a user, and thereby provide a product tail 16 of substantially a similar length following each pull by a user.

In an embodiment, the blocking mechanism 90 includes a stopper 92, such as a pawl, pivotally mounted to the supporting member 20 and at least one tooth 94 extending radially from the rotating drum assembly 32, at an end thereof, aligned with a distal end of the stopper 92. Engagement between the stopper 92 and the at least one tooth 94 defines a predetermined angular position beyond which the rotating drum assembly 32 is prevented from rotating in the counter dispensing rotating direction 37. Therefore, the blocking mechanism 90 operates to allow rotation of the rotating drum assembly 32 in the dispensing rotation direction 35, while preventing rotation of the rotating drum assembly 32 in the counter dispensing rotation direction 37 past a predetermined angular position, upon engagement of the stopper 92 with one of the at least one tooth 94, and resulting in the stationary configurations shown in FIGS. 3 and 4. The predetermined angular position defines a length of the product tail 16.

In the non-limitative embodiment shown, the at least one tooth 94 are provided on a disc of the rotating drum assembly 32 extending outwardly of the supporting member 20 and rotating simultaneously with the cutting drum 31.

In the illustrated embodiment, prevention of the rotation of the rotating drum assembly 32 in the counter dispensing rotation direction 37 past a predetermined angular position is achieved by an engagement end 93 of the stopper 92 being biased towards the rotating drum assembly 32 and each one of the at least one tooth 94 defining a predetermined angular position. Each one of the at least one tooth 94 is configured to engage with the engagement end 93 of the stopper 92 following a contact between the tooth 94 and the engagement end 93 of the stopper 92 as a result of the rotation of the rotating drum assembly 32 in the counter dispensing rotation direction 37 along a portion of the rotational path.

In the embodiment shown in FIGS. 2 to 4*a*, a pivoting assembly 95 is provided to allow a pivotal movement of the stopper 92 relative to the supporting member 20. In the embodiment shown, the pivoting assembly 95 is biased towards the rotating drum assembly 32 by gravity. In an alternative embodiment, the pivoting assembly 95 can include a biasing member (not shown), such as a spring or the like, configured to bias the engagement end 93 of the stopper 92 towards the rotating drum assembly 32. One skilled in the art would also understand that, in another alternative embodiment, other assembly or mechanism could be used to provide a stopper 92 configured to engage the at least one tooth provided on the rotating drum assembly 32, peripherally a section thereof. For example and without being limitative, a flexible stopper oriented towards the rotating drum assembly 32 could be used instead of a pivoting stopper 92.

Figure 3A:
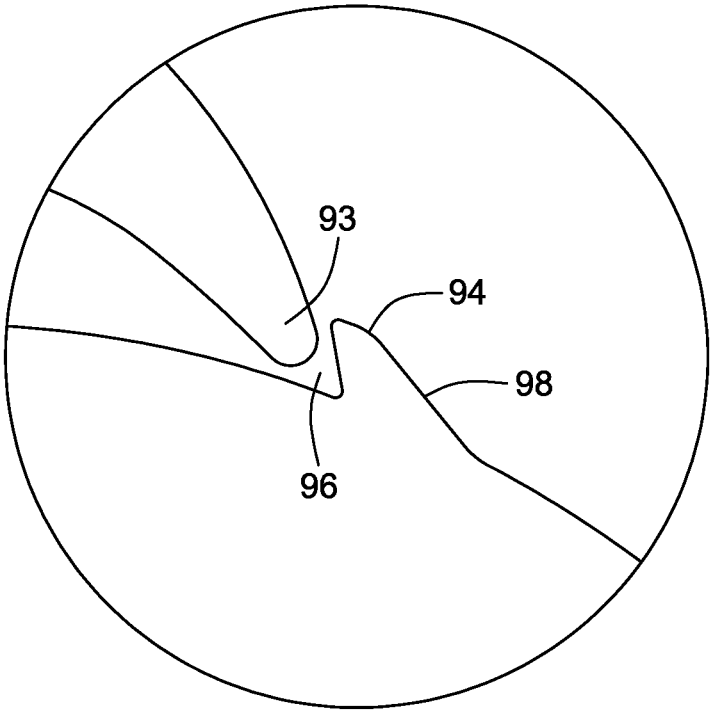
FIG. 3A is an enlarged view of section 3A of FIG. 3.

Referring now to FIG. 3A, in the embodiment shown, each one of the at least one teeth 94 is configured such that a cavity 96 is defined between the tooth 94 and the periphery of a section of the rotating drum assembly 32 at the corresponding end, on a first side of the tooth 94, and an inclined wall 98 is formed between the tooth 94 and the periphery of the section of the rotating drum assembly, on a second side of the tooth 94. The cavity 96 is oriented towards the engagement end 93 of the stopper 92 when the rotating drum assembly 32 rotates in the counter dispensing rotation direction 37. Consequently, when the rotating drum assembly 32 is rotated in the dispensing rotation direction 35, each time the rotation of the rotating drum assembly 32 causes one of the teeth 94 to contact the engagement end 93 of the stopper 92, the engagement end 93 of the stopper 92 contacts the inclined wall 98 and is driven over the corresponding tooth 94. However, when the rotating drum assembly 32 is rotated in the counter dispensing rotation direction 37, the engagement end 93 of the stopper 92 is moved into the cavity 96 of the first tooth 94, i.e. the tooth defining one of the at least one predetermined angular position, which comes into contact with the engagement end 93 of the stopper and prevents further rotation of the rotating drum assembly 32 in this direction. Therefore, the rotating drum assembly 32 can only rotate in the counter dispensing rotation direction 37 of an angular distance corresponding to the distance between the angular position reached following a pull of the product tail 16 by a user and the angular position reached when the engagement end 93 of the stopper 92 is engaged with one of the teeth 94 defining a predetermined angular position.

In an embodiment, the at least one tooth 94, defining one of the at least one predetermined angular position, is configured to allow rotation of the rotating drum assembly 32 in the counter dispensing rotation direction 37 of an angular distance of at least 60 degrees. Therefore, at least about 60 degrees of the rotating drum assembly 32, in front of the tooth 94 defining one of the at least one predetermined angular position, i.e. in the direction of arrow 35 in the embodiment shown, is free of tooth. In other words, the rotating drum assembly 32 includes a toothless circular arc segment 97 in front of the tooth 94 defining a predetermined angular position of at least about 60 degrees. In an alternative embodiment, the toothless circular arc segment 97 covers at least about 90 degrees of the circumference of the rotating drum assembly 32 and thus rotation of the rotating drum assembly 32 in the counter dispensing rotation direction 37 of an angular distance of at least 90 degrees is allowed.

Referring to FIGS. 3 and 3*a*, in an embodiment, the blocking mechanism 90 includes a pair of opposed teeth 94 extending radially from the rotating drum assembly 32, at the end thereof, aligned with the stopper 92. In other words, in the embodiment shown, the teeth 94 are spaced of about 180 degrees from one another along the periphery of the rotating drum assembly 32 and thereby allow a rotation in the counter dispensing rotation direction along about 180 degrees. In other words, a toothless circular arc segment 97 of about 180 degrees extends between the opposed teeth 94. Each one of the teeth 94 can define a predetermined angular position to prevent further rotation of the rotating drum assembly 32 in the counter dispensing rotation direction.

One skilled in the art will understand that, in an alternative embodiment, the number and/or positioning of the teeth 94 could differ from the pair of opposed teeth 94 of the illustrated embodiment of FIGS. 3 and 3*a*. For example and without being limitative, in an alternative embodiment (not shown), a single tooth 94 can extend radially from the rotating drum assembly 32, thereby allowing a rotation in the counter dispensing rotation direction along about 360 degrees. In other alternative embodiments (not shown), given for the purpose of exemplification only, three or four teeth 94, spaced apart along the periphery of the rotating drum assembly 32, can also be provided, with the teeth 94 being positioned to allow a rotation in the counter dispensing rotation direction along at least 90 degrees. Forwardly of each tooth 94 defining one of the predetermined angular positions, the rotating drum assembly 32 includes a toothless circular arc segment 97.

Figure 4:
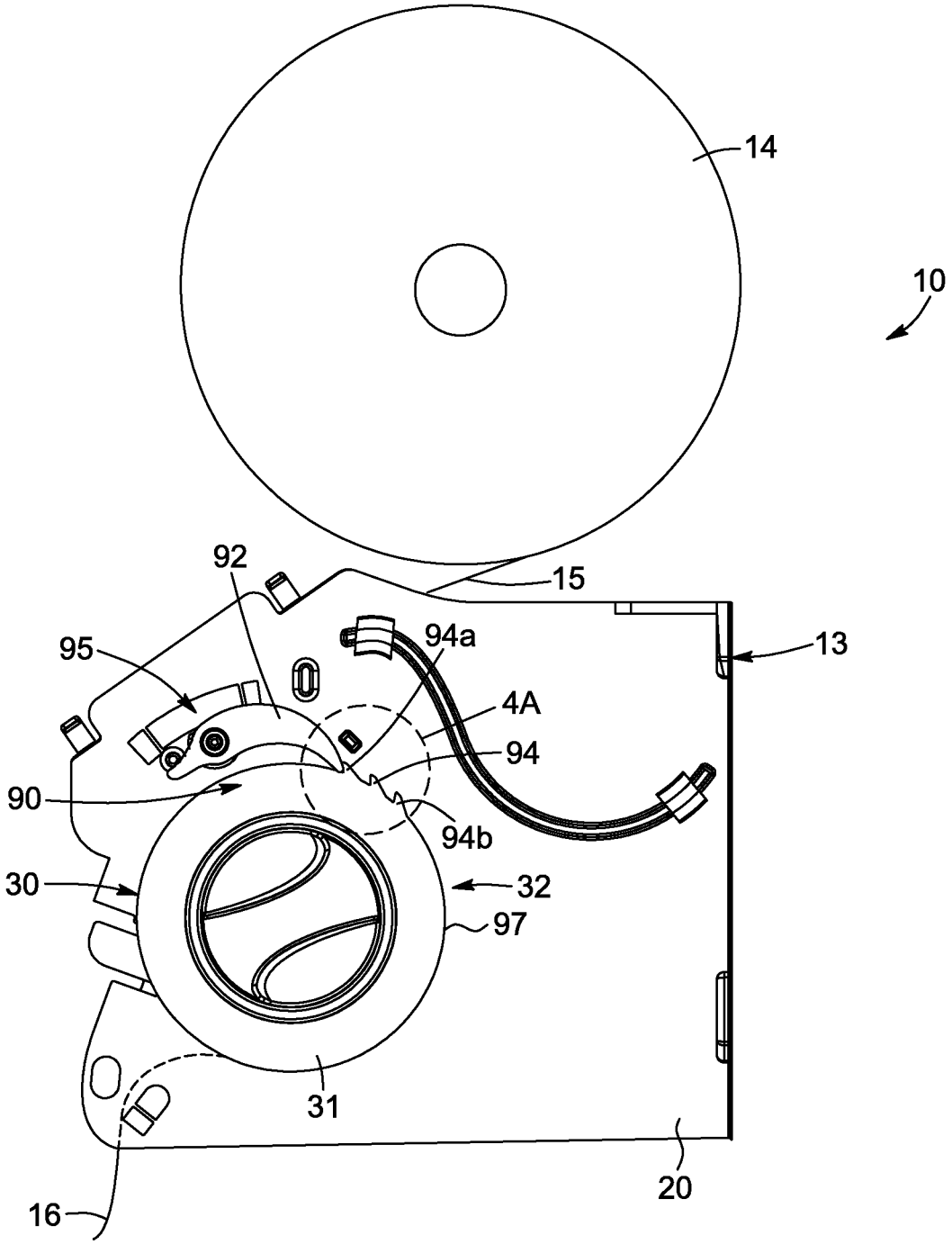
FIG. 4 is a right side elevation view of a rolled product dispenser, according to an alternative embodiment, where the housing has been removed and where the blocking mechanism includes a set of adjacent teeth extending radially from a periphery of the rotating drum assembly, the dispensing assembly of the rolled product dispenser being shown in the stationary configuration.
Figure 4A:
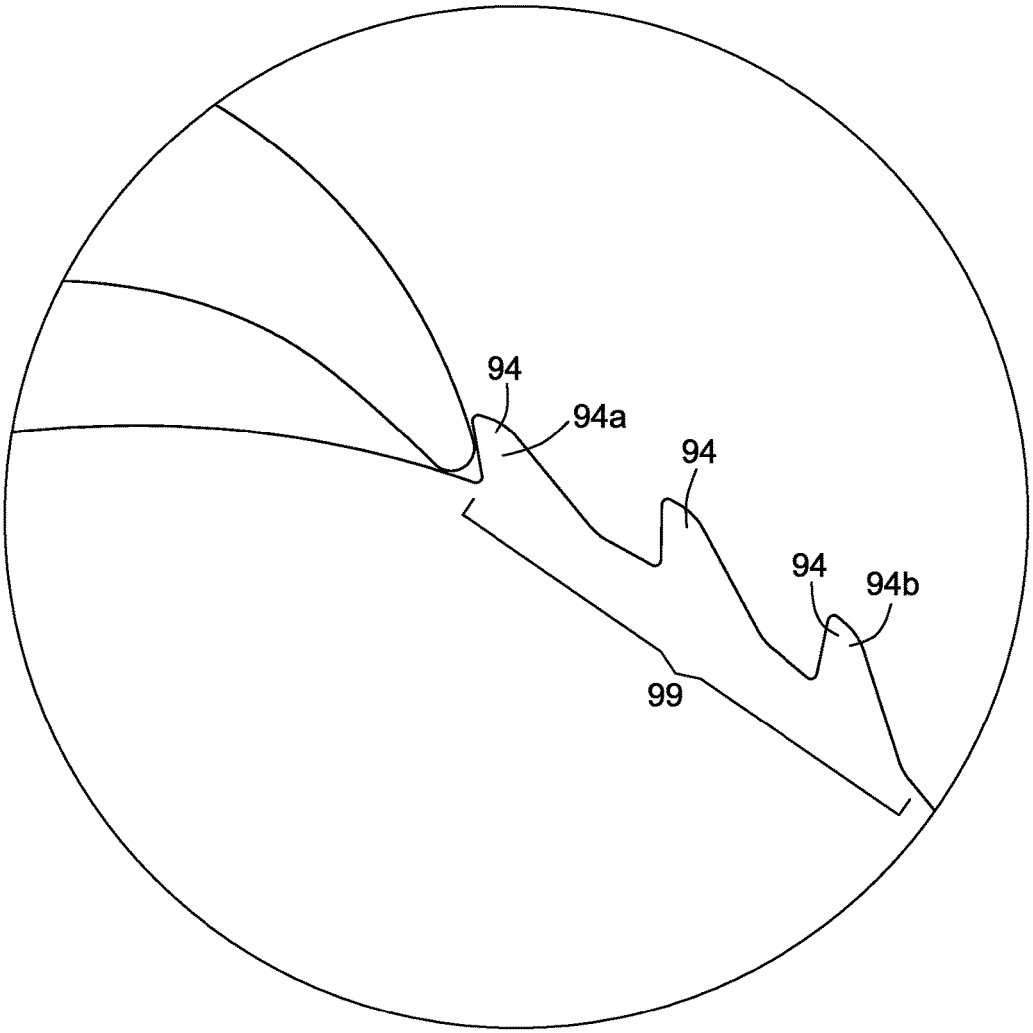
FIG. 4A is an enlarged view of section 4A of FIG. 4.

Now referring to FIGS. 4 and 4*a*, in an embodiment, the blocking mechanism 90 includes a set 99 of three adjacent teeth 94 extending radially from the rotating drum assembly 32, at the end thereof, and aligned with the stopper 92. Adjacent teeth 94 of the set of adjacent teeth 99 are proximate to one another along the periphery of the rotating drum assembly 32 with a toothless circular arc segment 97 extending between the last tooth 94*b* of the set of adjacent teeth 99 and the first tooth 94*a* of the set of adjacent teeth 99. The first tooth 94*a* of the set of adjacent teeth 99 defines the predetermined angular position to prevent further rotation of the rotating drum assembly 32. In the embodiment shown, the toothless circular arc segment 97 extends along about between 355 degrees and 300 degrees, forwardly of the tooth 94*a* defining the predetermined angular position. In a non-limitative embodiment, at least 300 degrees of the periphery of the rotating drum assembly includes the at least one toothless circular arc segment. For instance, the rotating drum assembly can include one set of consecutive teeth and at least 300 degrees of a toothless circular arc segment extending between a first tooth and a last tooth of the set. In another embodiment, the rotating drum assembly can include two or more sets of at least one tooth and the sum of the toothless circular arc segments extending between consecutive sets covers at least 300 degrees of the periphery of the rotating drum assembly. In an embodiment, the first tooth of each set, i.e. the first tooth encountered by the stopper 92 when rotating in the counter dispensing rotation direction defines a predetermined angular position for stopping further rotation of the rotating drum assembly 32. Toothless circular arc segments extend forwardly of each first tooth 94*a* and each one covers at least 60 degrees of the rotating drum assembly 32.

One skilled in the art will understand that, in an alternative embodiment, the number and/or positioning of the teeth 94 in the set of adjacent teeth 99 could differ from the illustrated embodiment of FIGS. 4 and 4*a*. For example and without being limitative, in an alternative embodiment (not shown), the set of adjacent teeth 94 can include only two teeth 94 or more than three teeth adjacent to one another and/or the distance between the adjacent teeth 94 of the set of adjacent teeth can be varied.

Moreover, in another alternative embodiment (not shown), more than one set 99 of teeth 94 can be provided with a toothless circular arc segment 97 extending between the last tooth 94*b* of one set of adjacent teeth 99 and the first tooth 94*a* of an adjacent set of adjacent teeth 99. For example and without being limitative, two or three sets of adjacent teeth 99 can be provided and be positioned to allow a rotation in the counter dispensing rotation direction along at least 60 degrees or at least 90 degrees between each set of adjacent teeth 99. Each first tooth 94*a* of each set defines a predetermined angular position for stopping further rotation of the rotating drum assembly 32, as detailed above.

It will be understood that, the use of a set of adjacent teeth 99 provides additional security teeth (i.e. the teeth following the first tooth 94*a* of the set of adjacent teeth 99) to prevent rotation of the rotating drum assembly 32 in the counter dispensing rotation direction 37, past a predetermined angular position, in cases where an initial engagement between the first tooth 94*a* of the set of adjacent teeth 99 and the stopper 92 is unsuccessful. Hence, in such a case where the initial engagement between the first tooth 94*a* of the set of adjacent teeth 99 and the stopper 92 is unsuccessful, the stopper 92 can engage a successive one of the teeth 94 of the set of adjacent teeth 99 to prevent rotation of the rotating drum assembly 32 in the counter dispensing rotation direction 37, with the rotating drum assembly 32 having rotated in the counter dispensing rotation direction 37 of only a few additional degrees, thereby leading to only a short difference for the length of the product tail 16.

The combination of the return mechanism 70 and the blocking mechanism 90 allows the length of the product tail 16 to be reduced to substantially the same length between each pull by a user. In more details, the rotation of the rotating drum assembly 32 in the counter dispensing rotation direction 37, caused by the return mechanism 70, results in the product tail 16 being brought to a retracted configuration (shown in FIGS. 3, 4 and 5) from an extended configuration (shown in FIG. 2) reached following a pull on the product tail 16 by a user and a cutting of the web of rolled product by the cutting assembly (not shown). The retracted position of the product tail 16 results in a length of the product tail 16 that is substantially the same following each pull, given that the blocking mechanism 90 prevents the rotating drum assembly 32 from rotating further than angular positions defined by the position of the at least one tooth 94. In an embodiment, the resulting product tail 16 should be long enough to allow a user to seize the product for another pull, but short enough to reduce possible bacterial contamination and product waste. Therefore, in a non-limitative embodiment, the combination of the return mechanism 70 and the blocking mechanism can be set to result in a product tail 16 which extends outwardly of the housing 12 of a length of between about 1½ inch to 2 inches between each pull of a user.

In the embodiment shown, the return mechanism 70 is positioned at one end of the rotating drum assembly 32 beyond and proximate to the supporting member 18 and the blocking mechanism 90 is positioned at an opposed end of the rotating drum assembly 32 beyond and proximate to the supporting member 20. One skilled in the art would however understand that, in an alternative embodiment, the position of the return mechanism 70 and the blocking mechanism 90 could be inverted, i.e. the return mechanism 70 being positioned at the end of the rotating drum assembly 32 proximate to the supporting member 20 and the blocking mechanism 90 being positioned at the opposed end of the rotating drum assembly 32 proximate to the supporting member 18. Moreover, in another alternative embodiment, the return mechanism 70 and the blocking mechanism 90 can be positioned at the same end of the rotating drum assembly 32. Moreover, it will be understood that, in an embodiment, the return mechanism 70 and the blocking mechanism 90 can be positioned internally with regards to the supporting members 18, 20 rather than externally. The stopper 92 of the blocking mechanism 90 and the anchor 74 of the return mechanism 70 can also be mounted to the housing 12.

In view of the above, it will be understood that while conventional dispensing assemblies are commonly provided with a one-way clutch assembly or a one-way spring assembly, which allows rotation of a rotating drum assembly in a single dispensing rotational direction, the dispensing assembly 30 of the present dispenser 10 allows rotation of the rotating drum assembly 32 in both rotational directions, the dispensing assembly 30 allowing rotation in the counter dispensing rotation direction 37 along solely a portion of the rotational path, as described in more details above. Therefore, as detailed above, the above described assembly allows to substantially control a length of the product tail 16 extending outwardly of the housing 12, following each pull of the rolled product.

Moreover, it will be understood that the limited number of teeth extending radially from the rotating drum assembly 32 limits the number of instances where the stopper 92 of the blocking mechanism 90 is driven over a corresponding tooth 94 when rotating in the dispensing rotational direction 35, thereby reducing the associated clicking noise. Hence, a dispenser using the above described dispensing assembly 30 results in an overall quieter dispenser, as opposed to dispensers where teeth 94 are provided radially over the entire periphery of the rotating drum assembly or a substantial portion thereof.

A product dispenser 10 having been described in details above, a sequence of operation of at least a portion of the operations of the dispenser will now be detailed.

In an embodiment, the following sequence of operation occurs during and shortly after the dispensing of a length of rolled product 14 to a user, when using the above described dispenser 10. The dispensing of a length of the web 15 of rolled product 14 is initiated by a user pulling on the product tail 16 extending from the housing 12 of the dispenser 10. The continuous pull by the user causes the web 15 of rolled product 14 to drive the rotating drum assembly 32 in rotation in the dispensing rotation direction 35. Following the dispensing of a predetermined length of rolled product, the web 15 of rolled product 14 is severed, such that the length to be dispensed for use is detached therefrom. The rotating drum assembly 32 is subsequently driven in rotation in the counter dispensing rotation direction 37 by the return mechanism 70, until the blocking mechanism 90 halts the rotation of the rotating drum assembly 32 in the counter dispensing rotation direction 37. In the embodiments described above, the prevention of the rotation of the rotating drum assembly 32 in the counter dispensing rotation direction 37 occurs as a result of the stopper 92 engaging one of the teeth 94 defining a predetermined angular position, thereby reducing the length of the paper tail 16 extending from the housing 12.

Several alternative embodiments and examples have been described and illustrated herein. The embodiments of the invention described above are intended to be exemplary only. A person skilled in the art would appreciate the features of the individual embodiments, and the possible combinations and variations of the components. A person skilled in the art would further appreciate that any of the embodiments could be provided in any combination with the other embodiments disclosed herein. It is understood that the invention may be embodied in other specific forms without departing from the central characteristics thereof. The present examples and embodiments, therefore, are to be considered in all respects as illustrative and not restrictive, and the invention is not to be limited to the details given herein. Accordingly, while the specific embodiments have been illustrated and described, numerous modifications come to mind without significantly departing from the scope of the invention as defined in the appended claims.

The invention claimed is:

1. A rolled product dispenser for dispensing a web of rolled product, the rolled product dispenser comprising:

a housing;

a dispensing assembly at least partially housed in the housing and interacting with the web of rolled product, the dispensing assembly including a rotating drum assembly rotatable in a dispensing rotation direction and a counter dispensing rotation direction along at least 60 degrees;

a return mechanism biasing the rotating drum assembly towards a stationary configuration by rotating same in the counter dispensing rotation direction; and a blocking mechanism allowing rotation of the rotating drum assembly in the dispensing rotation direction and preventing rotation of the rotating drum assembly in the counter dispensing rotation direction beyond at least one predetermined angular position, wherein the blocking mechanism includes a stopper and the rotating drum assembly comprises at least one set of adjacent and consecutive teeth protruding radially from a section of the rotating drum assembly and at least one toothless circular arc segment extending between a first one of the teeth of one of the at least one set of adjacent and consecutive teeth and a last one of the teeth of one of the at least one set of adjacent and consecutive teeth, the at least one toothless circular arc segment extending along at least 60 degrees to drive a length of the rolled product back in the housing, the stopper being engageable with one of the teeth to prevent rotation of the rotating drum assembly in the counter dispensing rotation direction beyond the at least one predetermined angular position.

2. The rolled product dispenser of claim 1, wherein the stopper is pivotally mounted to one of a dispensing assembly frame and the housing through a pivoting assembly biasing an engagement end of the stopper towards the rotating drum assembly.

3. The rolled product dispenser of claim 1, wherein the rotating drum assembly comprises at least one set of adjacent and consecutive teeth engageable with the stopper when the rotating drum assembly is rotated in the counter dispensing rotation direction with the at least one toothless circular arc segment comprising one toothless circular segment extending between a first one of the teeth and a last one of the teeth of the at least one set of adjacent and consecutive teeth at a periphery of the section of the rotating drum assembly.

4. The rolled product dispenser of claim 3, wherein the at least one set of adjacent and consecutive teeth comprises five or less teeth.

5. The rolled product dispenser of claim 1, wherein the at least one toothless circular arc segment extends along at least 90 degrees.

6. A rolled product dispenser for dispensing a web of rolled product, the rolled product dispenser comprising:

a dispensing assembly including a rotating drum assembly having a peripheral wall configured to be contoured at least partially by the web of rolled product and being rotatable in a dispensing rotation direction and a counter dispensing rotation direction along at least 60 degrees;

a return mechanism biasing the rotating drum assembly towards a stationary configuration by rotating same in the counter dispensing rotation direction; and a blocking mechanism engageable with the rotating drum assembly to prevent rotation thereof in the counter dispensing rotation direction beyond at least one predetermined angular position, wherein the blocking mechanism includes a stopper and the rotating drum assembly comprises at least one set of adjacent and consecutive teeth protruding radially from a section of the rotating drum assembly and at least one toothless circular arc segment extending between a first one of the teeth of one of the at least one set of adjacent and consecutive teeth and a last one of the teeth of one of the at least one set of adjacent and consecutive teeth, the at least one toothless circular arc segment extending along at least 60 degrees to drive a length of the rolled product back in the housing, the stopper being engageable with one of the teeth to prevent rotation of the rotating drum assembly in the counter dispensing rotation direction beyond the at least one predetermined angular position.

7. The rolled product dispenser of claim 6, wherein the stopper is pivotally mounted to one of a dispensing assembly frame and a housing of the rolled product dispenser through a pivoting assembly and at least one tooth of the at least one set of adjacent and consecutive teeth protrudes from the peripheral wall of the section of the rotating drum assembly and the pivoting assembly biases an engagement end of the stopper towards the peripheral wall of the section of the rotating drum assembly.

8. The rolled product dispenser of claim 6, wherein the rotating drum assembly comprises one set of adjacent and consecutive teeth engageable with the stopper when the rotating drum assembly is rotated in the counter dispensing rotation direction with the at least one toothless circular arc segment comprising one toothless circular segment extending between a first one of the teeth and a last one of the teeth of the at least one set of adjacent and consecutive teeth at a periphery of the section of the rotating drum assembly.

9. The rolled product dispenser of claim 8, wherein the at least one set of adjacent and consecutive teeth comprises five or less teeth.

10. The rolled product dispenser of claim 6, wherein the at least one toothless circular arc segment extends along at least 90 degrees.

* * * * *